US008282166B2

(12) United States Patent
Piretti

(10) Patent No.: US 8,282,166 B2
(45) Date of Patent: Oct. 9, 2012

(54) CHAIR WITH TILTABLE BACKREST

(75) Inventor: Giancarlo Piretti, Bologna (IT)

(73) Assignee: Pro-Cord S.p.A., Bologna (IT)

( * ) Notice: Subject to any disclaimer, the term of this patent is extended or adjusted under 35 U.S.C. 154(b) by 316 days.

(21) Appl. No.: 12/612,959

(22) Filed: Nov. 5, 2009

(65) Prior Publication Data

US 2010/0109403 A1 May 6, 2010

(30) Foreign Application Priority Data

Nov. 6, 2008 (EP) ..... 08425712

(51) Int. Cl.
*A47C 3/00* (2006.01)

(52) U.S. Cl. ..... 297/294; 297/296; 297/301.1

(58) Field of Classification Search ..... 297/294, 297/296, 297, 298, 301.1, 285
See application file for complete search history.

(56) References Cited

U.S. PATENT DOCUMENTS 2,587,822 A * 3/1952 Corning ..... 403/220
4,549,764 A * 10/1985 Haedo ..... 297/296
4,603,904 A * 8/1986 Tolleson et al. ..... 297/296
4,787,678 A * 11/1988 Holmes et al. ..... 299/39.3
4,869,552 A * 9/1989 Tolleson et al. ..... 297/296
5,445,471 A * 8/1995 Wexler et al. ..... 403/220
6,328,047 B1 * 12/2001 Lee ..... 135/20.1
6,739,663 B2 * 5/2004 Gevaert ..... 297/296

FOREIGN PATENT DOCUMENTS

WO WO 91/03191 3/1991

* cited by examiner

*Primary Examiner* — Sarah B McPartlin
(74) *Attorney, Agent, or Firm* — Patterson & Sheridan, L.L.P.

(57) ABSTRACT

A chair comprising, a base structure including two rear tubular elements open at the top, a backrest having two tubular portions open at the bottom and aligned to said tubular elements of the base structure, and two elastic devices, each of which has a top support inserted in a tubular portion of the backrest, a bottom support inserted in the corresponding tubular element of the base structure, and an elastic element flexurally deformable to enable tilting between the top support and the bottom support, wherein each of said elastic devices comprises a plurality of sectors stacked on top of one another and arranged between the top support and the bottom support, and wherein, in a resting position of the elastic element, a plurality of slits are formed on the rear side of each elastic device between each pair of adjacent sectors.

13 Claims, 7 Drawing Sheets

20
22
22
26
42
28
V
10
24
26
42
III
14
12
28
V
18
16
16
18

CHAIR WITH TILTABLE BACKREST

CROSS-REFERENCE TO RELATED APPLICATIONS

This application claims benefit of European patent application number 08425712.0, filed Nov. 6, 2008, which is herein incorporated by reference.

BACKGROUND OF THE INVENTION

1. Field of the Invention

The present invention relates to a chair with a tiltable backrest that is biased elastically into a resting position and can be tilted under the action of a backwards thrust applied by the back of the user.

More precisely, the invention relates to a chair in which the backrest is connected to a base structure by means of a pair of elastic devices, each of which comprises a top support, inserted in a tubular portion of the backrest, a bottom support, inserted in a tubular element of the base structure, and a flexurally deformable elastic element that enables tilting between the top support and the bottom support.

2. Description of the Related Art

WO 91/03191 discloses a chair with tiltable backrest including a base structure including two rear tubular elements, a backrest and two elastic devices, each of which has a top support inserted in a tubular portion of the backrest, a bottom support inserted in the corresponding tubular element of the base structure, and an elastic element having a top stretch fixed to the top support and a bottom stretch fixed to the bottom support, the elastic element being flexurally deformable to enable tilting between the top support and the bottom support.

In the solution described in WO 91/03191, provided between the facing ends of the two supports of each elastic element is an empty space of ample dimensions for enabling a movement of backwards tilting of the backrest with the desired amplitude. The space of large dimensions between the mobile supports, as described in WO 91/03191, exposes the user to a risk of getting pinched. In order to limit this risk, in the solution described in WO 91/03191 there is provided a bellows-shaped element with flexible structure, which surrounds the open area between the two supports of each elastic element. However, the bellows-shaped element does not completely eliminate the risk of pinching, is subject to failure, and has a negative impact from the aesthetic standpoint.

SUMMARY OF THE INVENTION

The object of the present invention is to provide a chair that overcomes said drawbacks.

According to the present invention, said object is achieved by a chair of the type mentioned above, wherein each of said elastic devices comprises a plurality of sectors set on top of one another and arranged between the top support and the bottom support, wherein the elastic element has a central stretch extending through said sectors and wherein, in a resting position of the elastic element, a plurality of slits are formed on the rear side of each elastic device between each pair of adjacent sectors, and wherein each elastic device includes an elongated flat spring, the ends of which are fixed to a top support and to a bottom support.

BRIEF DESCRIPTION OF THE DRAWINGS

The characteristics and advantages of the present invention will emerge clearly in the course of the ensuing detailed description, which is provided purely by way of non-limiting example with reference to the annexed drawings, wherein.

DETAILED DESCRIPTION

Figure 1:
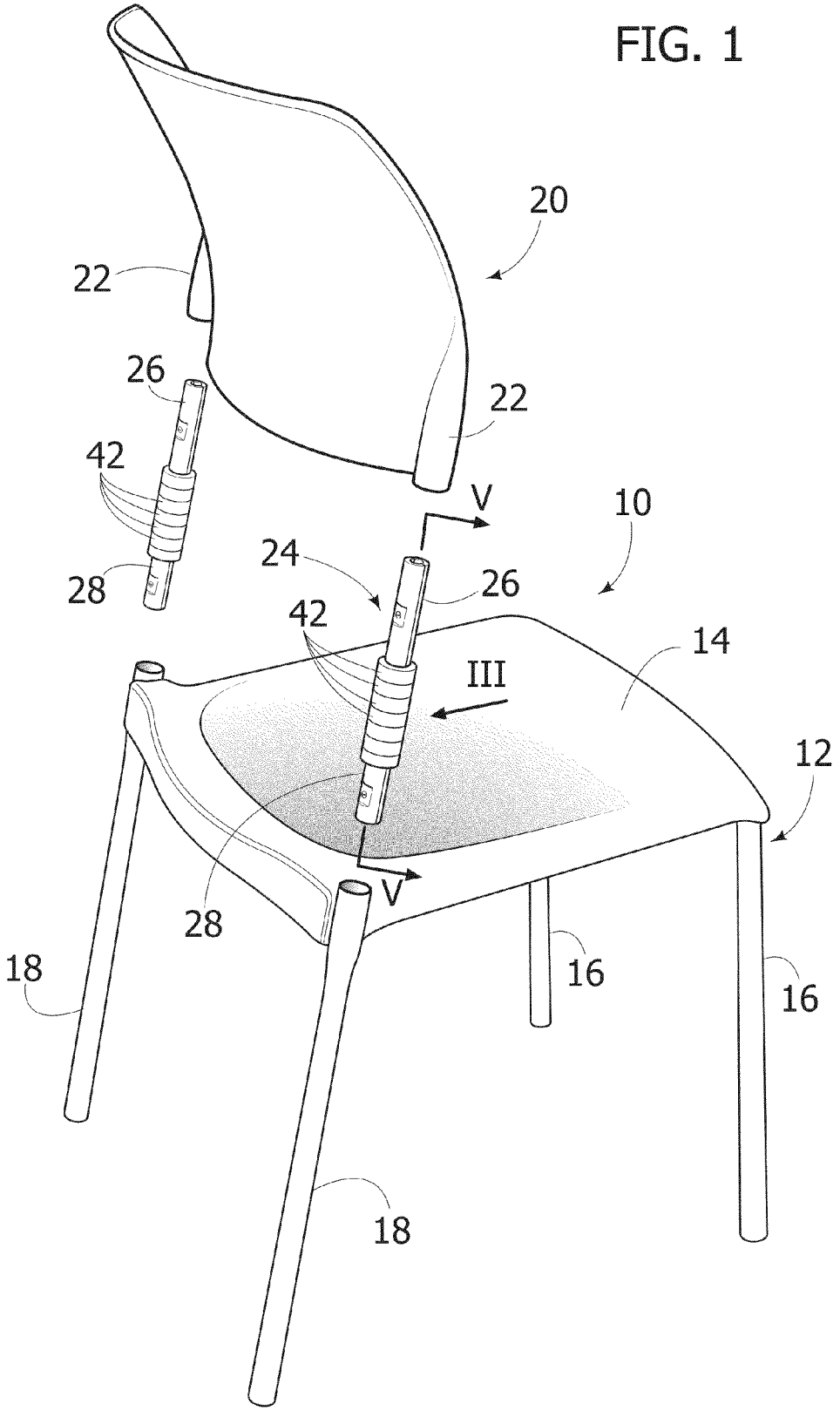
FIG. 1 is an exploded perspective view of a chair according to the present invention.
Figure 2:
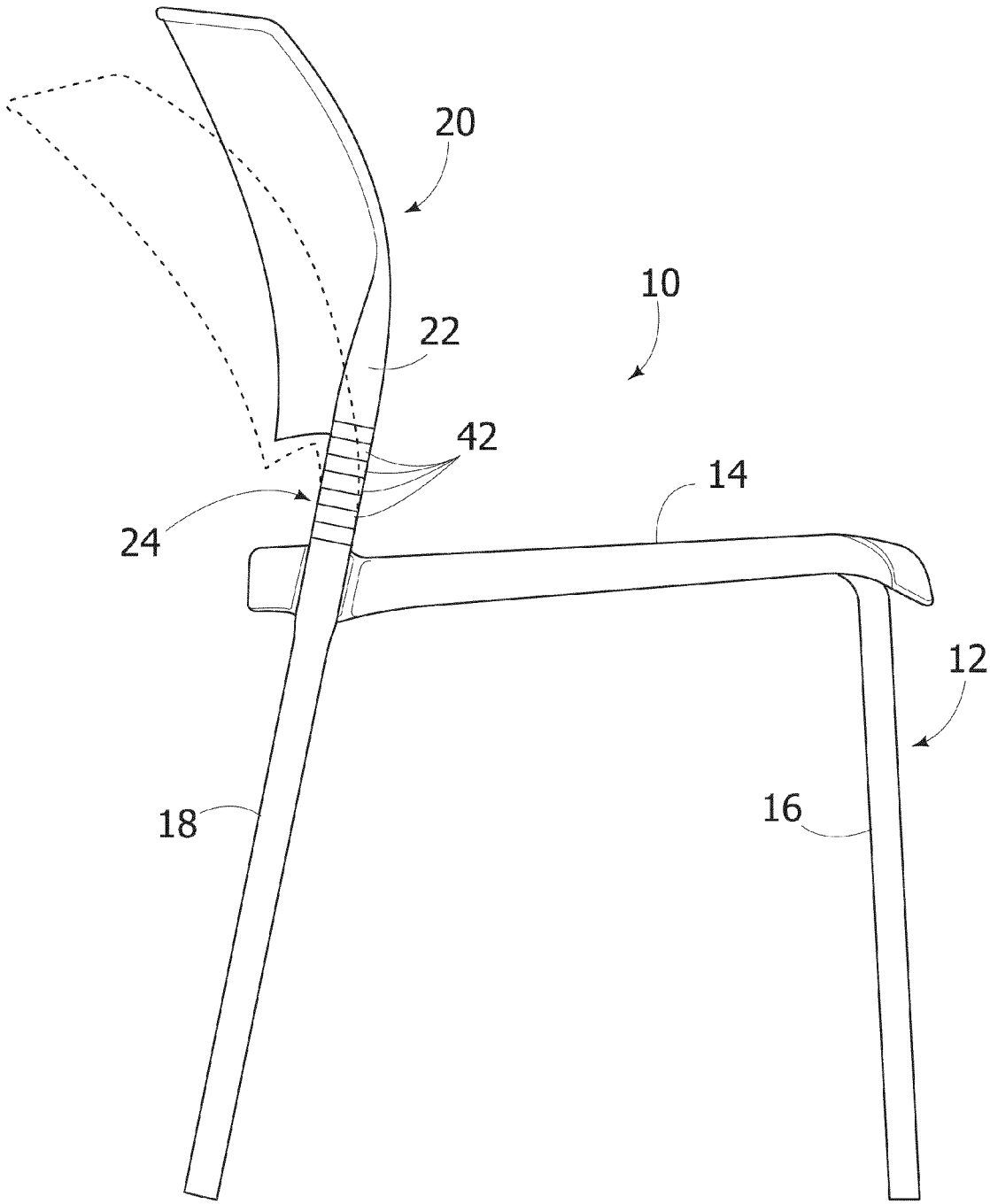
FIG. 2 is a side view of the chair of FIG. 1.

With reference to FIGS. 1 and 2, the reference number 10 designates a chair with tiltable backrest according to the present invention. The chair 10 comprises a base structure 12 bearing a seat 14. The base structure 12 comprises two pairs of tubular elements 16 and 18 forming the front legs and the rear legs of the chair 10. The tubular elements 18 forming the rear legs are open at their top ends, which terminate substantially flush with the rear part of the seat 14.

The chair 10 comprises a backrest 20 having two tubular side portions 22 open at their bottom ends and aligned to the tubular elements 18 of the base structure 12. Preferably, the backrest 20 is constituted by a body made of plastic material with an arched shape.

Figure 3:
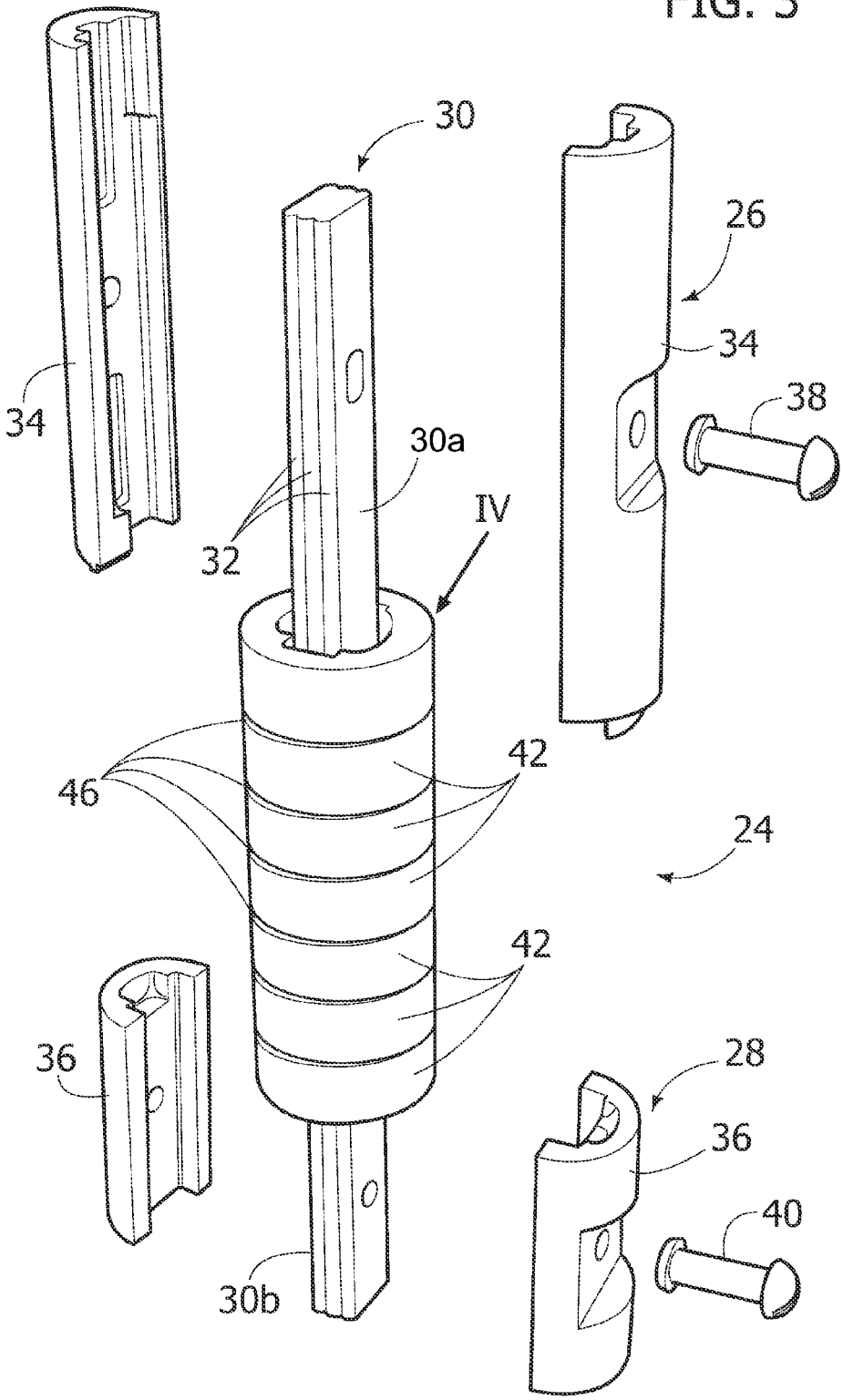
FIG. 3 is an exploded perspective view of an elastic device indicated by the arrow III in FIG. 1.
Figure 5:
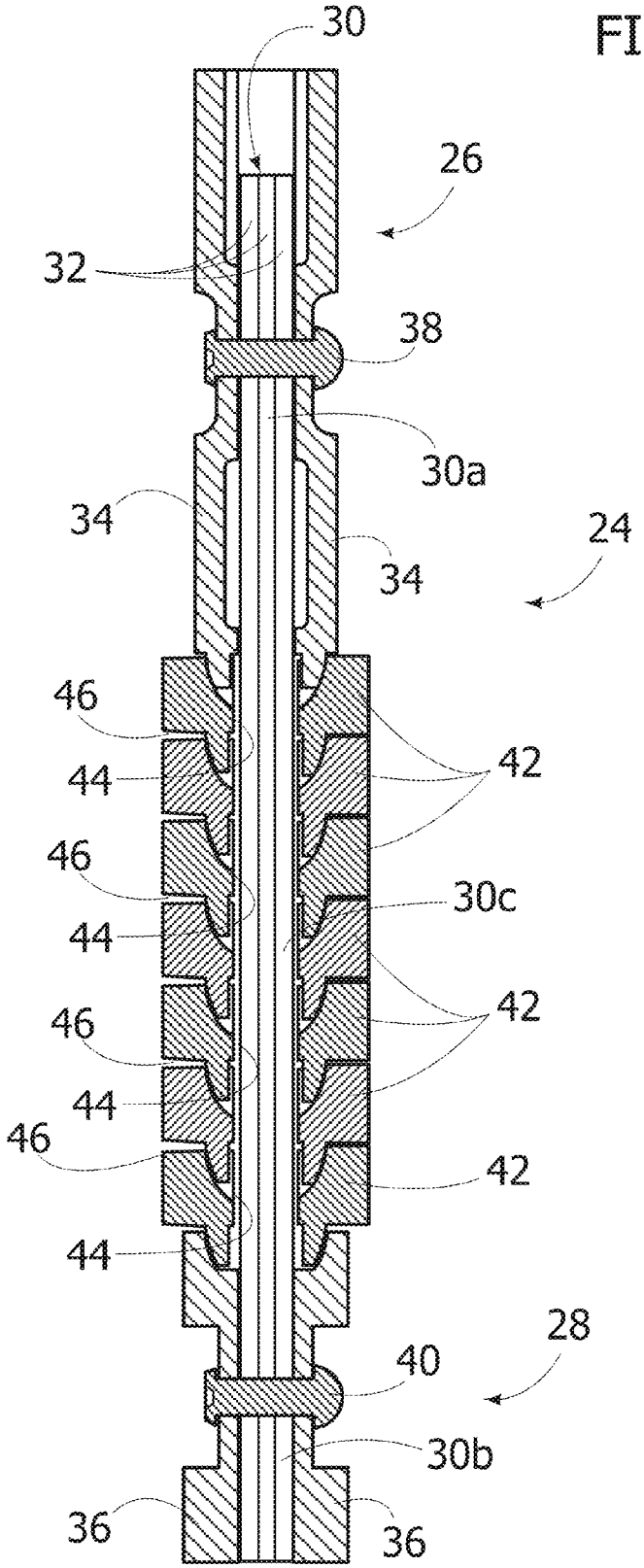
FIG. 5 is an axial section of an elastic device according to the line V-V of FIG. 1.
Figure 6:
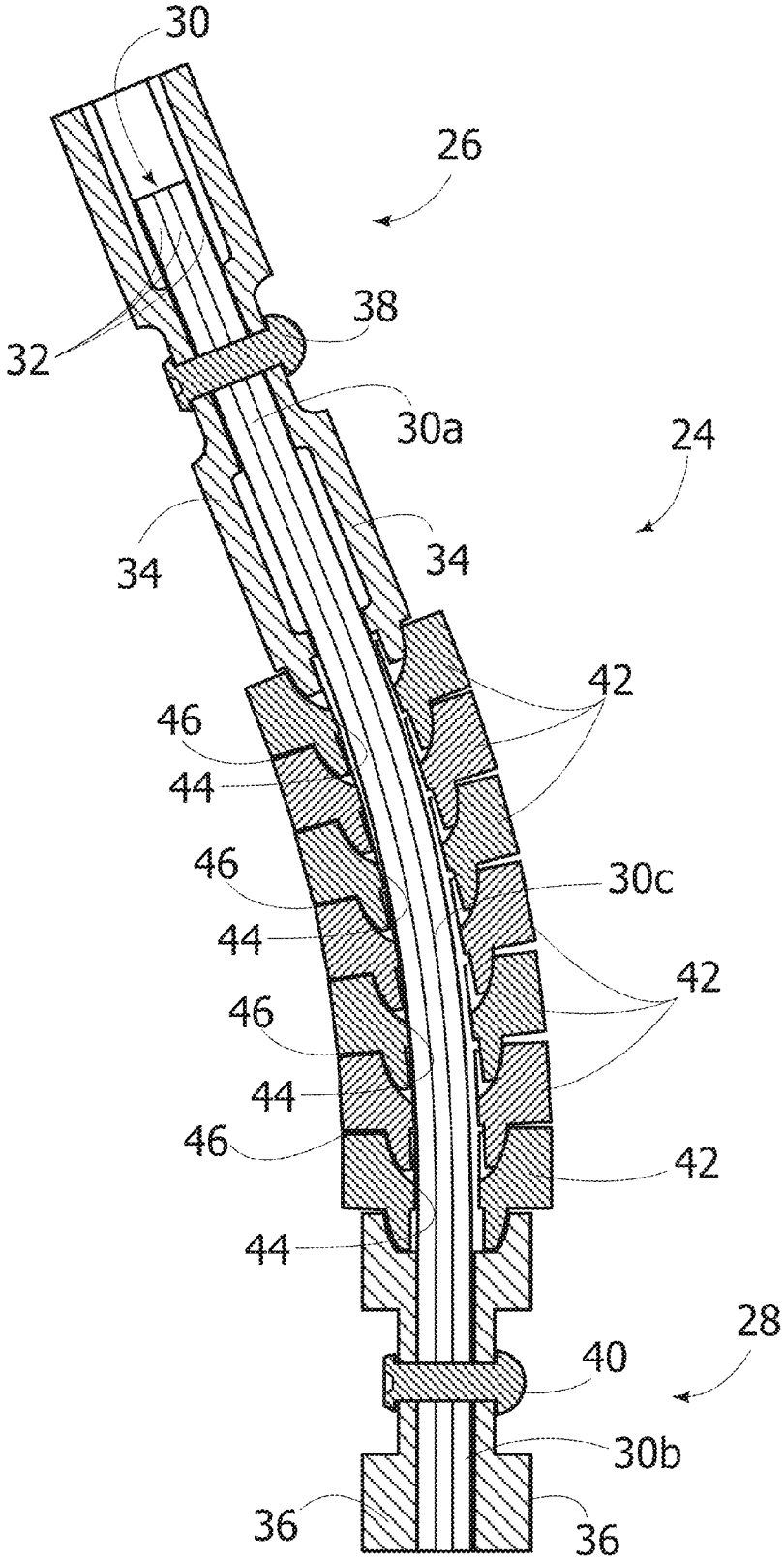
FIG. 6 is a section similar to that of FIG. 5 illustrating the elastic device in the position of maximum backwards inclination.

The backrest 20 is connected to the base structure 12 by means of two elastic devices 24. With reference to FIGS. 3, 5 and 6, each elastic device 24 comprises a top support 26, a bottom support 28, and a flexurally deformable elastic element 30.

The elastic element 30 can, for example, be constituted by a series of flexible metal plates 32 set alongside one another, each of the metal plates 32 having the shape of an elongated strip. Said arrangement is not, however, to be considered imperative. From the constructional standpoint, the elastic element 30 may be made in various ways provided that it has a desired flexural stiffness.

The elastic element 30 has a top portion 30*a* fixed to the top support 26 and a bottom portion 30*b* fixed to the bottom support 28. Preferentially, the top support 26 and the bottom support 28 are each formed by a pair of shells 34, 36, set on opposite sides of the respective stretch of elastic element 30*a*, 30*b*.

The shells 34, 36 are fixed to one another by means of respective rivets 38, 40, which extend through aligned holes of the side parts 34, 36 and of the elastic element 30. Preferably, the side parts 34, 36 are made of metal material. The supports 34, 36 could in any case be obtained in another way; for example, said supports could be constituted by monolithic bodies with cavities, in which the respective stretches 30*a*, 30*b* of the elastic element 30 are received and fixed.

The supports 34, 36 are substantially rigid and undeformable. The top support 26 of each elastic device 24 is inserted and fixed in a respective tubular portion 22 of the backrest 20. The support 28 is inserted and fixed in the corresponding tubular element 18 of the base structure 12. Fixing of the supports 26, 28 in the tubular portions 22, 18 can be obtained by force driving.

Each elastic device 24 comprises a plurality of sectors 42 set on top of one another, which surround a central stretch 30*c* of the elastic element 30. The sectors 42 are contained between the bottom end of the top support 26 and the top end of the bottom support 28. The sectors 42 can be tilted with respect to one another so as to enable a deformation of the elastic device between a resting position illustrated in FIG. 5 and a backwards deflected position illustrated in FIG. 6. With reference in particular to FIG. 5, in a resting position of the elastic element 30, on the rear side of the elastic device 24 (i.e., the side facing the rear part of the chair 10) a plurality of slits 46 are formed between each pair of adjacent sectors 42. The slits 46 are substantially orthogonal with respect to the longitudinal axis of the elastic element 30.

In the embodiment illustrated in FIGS. 3 to 6, the sectors 42 are formed by bodies separate from one another. The sectors have respective holes 44 aligned with respect to one another, through which the central stretch 30*c* of the elastic element 30 extends.

Figure 4:
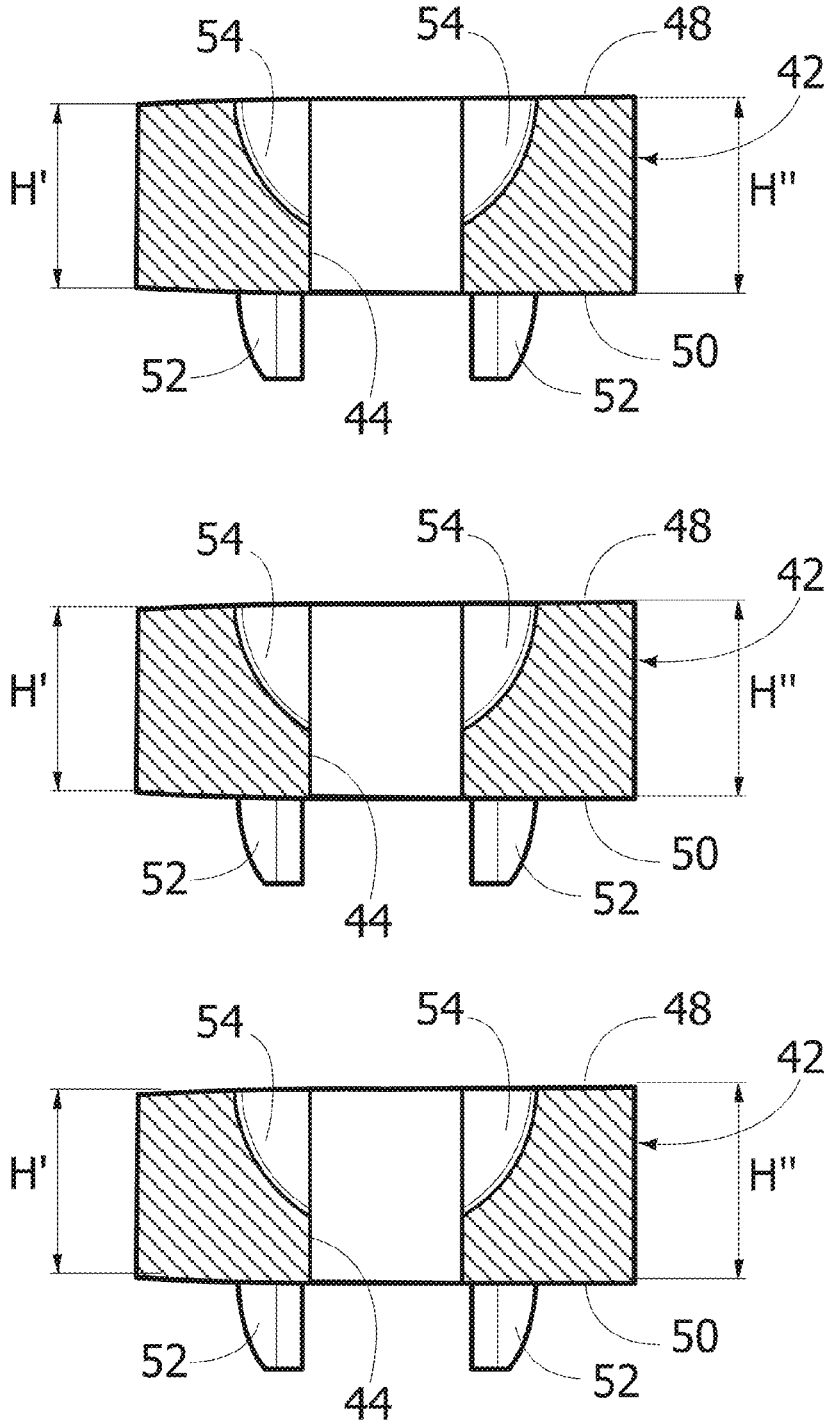
FIG. 4 is an exploded view illustrating some of the elements indicated by the arrow IV of FIG. 3.

With reference to FIG. 4, each sector 42 has a top front surface 48 and a bottom front surface 50. The surfaces 48 and 50 on the front part of the sectors 42 are orthogonal to the axis of the hole 44, whilst in the rear part of the sector 42 said surfaces are inclined, so that each sector 42 has in the rear part a height H' smaller than the height H" of the same sector in its front part. When the sectors 42 are stacked on top of one another, the front parts of the surfaces 48, 50 of each pair of adjacent sectors come into mutual contact and the slits 46 are formed between the rear parts of smaller height.

Preferably, each sector 42 has projecting formations 52 that engage corresponding cavities 54 of an adjacent sector. The projections 52 and the cavities 54 preferably have arched surfaces in mutual sliding contact. To carry out an assembly in which the sectors 42 will always be reciprocally oriented in a correct way, the front projections and cavities, which are complementary to one another, have a geometry that is different from the rear projections and cavities, which are likewise complementary to one another.

As may be noted from a comparison of FIGS. 5 and 6, in the resting position (FIG. 5) the elastic element 30 is rectilinear, and the two supports 26, 28 are aligned with respect to one another. In this condition, the slits 46 between the pairs of adjacent sectors 42 face the rear part of the elastic device 24.

FIG. 6 shows the elastic device 26 in the position of maximum backwards inclination. In this condition, the elastic element 30 is bent backwards, and the supports 26, 28 are inclined with respect to one another. The rear parts of the surfaces 48, 50 are in contact with one another and prevent any further backwards inclination of the top support 26 with respect to the bottom support 28. The sectors 42 hence constitute end-of-travel arrests that define the position of maximum backwards inclination of the backrest 20. In the position of maximum backwards inclination, the thickness of the slits 46 vanishes, and slits are formed between each pair of adjacent sectors 42 in the front part of the elastic device 24.

FIG. 2 shows the backrest 20 in the resting position and in the position of maximum backwards inclination (illustrated with a dashed line).

Figure 7:
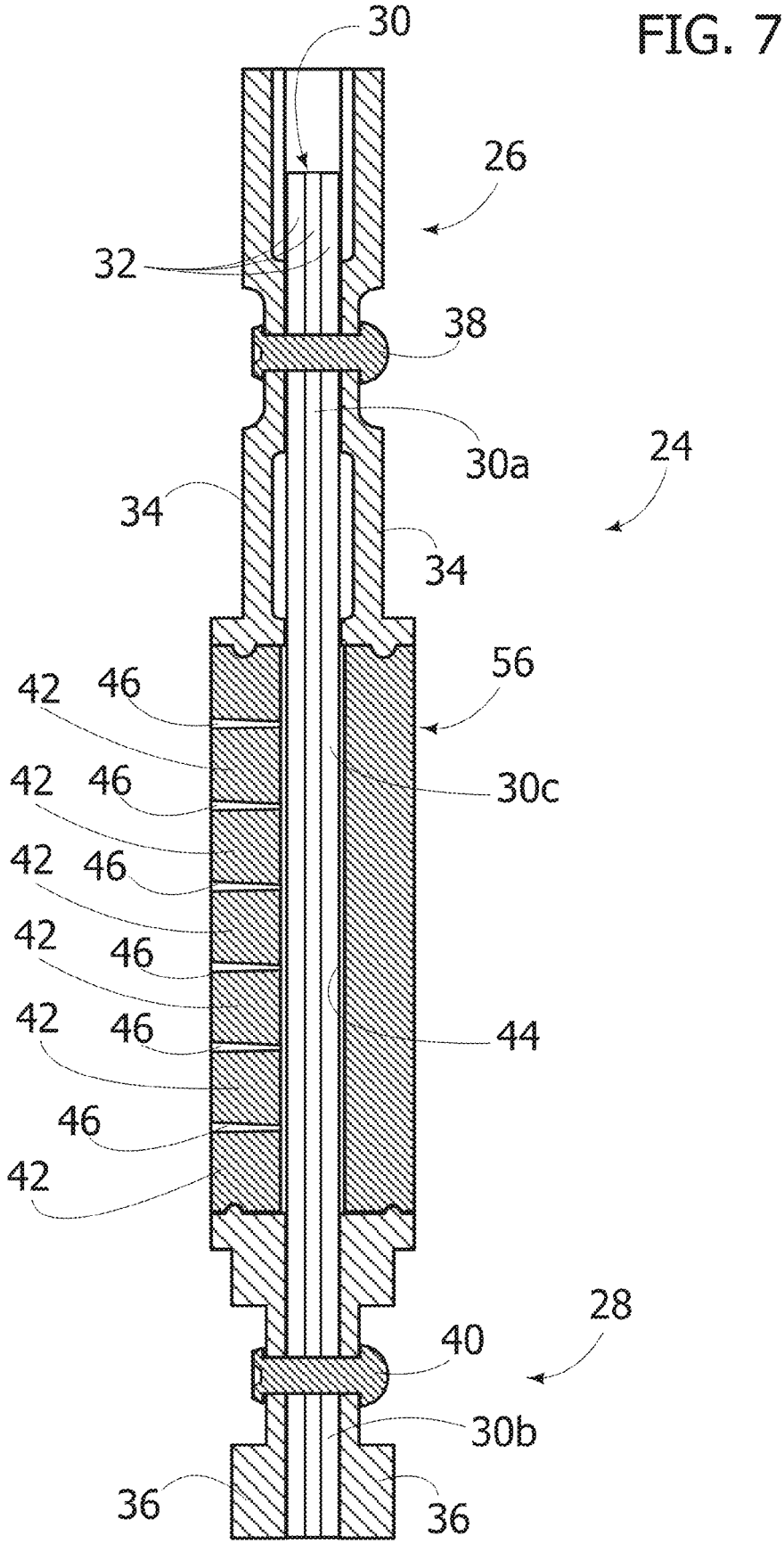
FIG. 7 is an axial section illustrating a variant of the elastic device according to the present invention.

FIG. 7 illustrates a variant of an elastic device 24 according to the present invention. The items corresponding to the ones previously described are designated by the same reference numbers.

In this variant, the sectors 42 are formed by sections set on top of one another of a monolithic body 56, provided in its rear part with a plurality of slits 46 that divide the adjacent sectors 42 from one another. The body 56 has a longitudinal hole 44, within which the central stretch 30*c* of the elastic element 30 extends. Preferably, the internal ends of the slits 46 extend as far as the longitudinal hole 44.

As in the variant described previously, the surfaces of each pair of adjacent sectors 42 facing one another come into contact with one another, following upon a backwards bending of the elastic element 30, and form an arrest that defines the position of maximum backwards inclination of the backrest.

One of the advantageous characteristics of the elastic device according to the present invention is that the slits 46 are very thin and do not entail any risks of pinching for the user. Then the elastic device 24 according to the invention does not need any flexible covering of the area of bending. From the aesthetic standpoint, the array of sectors 42 forms an aesthetic and styling continuity with the tubular portion 22 of the backrest that is remarkable from the aesthetic standpoint.

A further advantage of the solution according to the invention as compared to the one described in WO 91/03191 lies in the fact that the bending is no longer localized in a single point, but rather distributed along the plurality of sectors 42. This enables providing the user with a decidedly higher level of comfort as compared to the known solution.

While the foregoing is directed to embodiments of the present invention, other and further embodiments of the invention may be devised without departing from the basic scope thereof, and the scope thereof is determined by the claims that follow.

The invention claimed is:

1. A chair comprising:

a base structure bearing a seat, the base structure including two rear tubular elements open at the top;

a backrest having two tubular portions open at the bottom and aligned to said tubular elements of the base structure; and two elastic devices, each of which has a top support inserted in one of the tubular portions of the backrest, a bottom support inserted in the corresponding tubular element of the base structure, and an elastic element having a top stretch fixed to the top support and a bottom stretch fixed to the bottom support, wherein the top support and the bottom support are each formed by a pair of side parts, fixed to one another on opposite sides of the top stretch or of the bottom stretch of the elastic element, the elastic element being flexurally deformable to enable tilting between the top support and the bottom support, each of said elastic devices comprising a plurality of sectors set on top of one another and arranged between the top support and the bottom support, wherein the elastic element has a central stretch extending through said sectors and wherein, in a resting position of the elastic element, a plurality of slits are formed on the rear side of each elastic device between each pair of adjacent sectors.

2. The chair according to claim 1, wherein said sectors are formed by separate bodies, and said sectors are stacked on top of one another.

3. The chair according to claim 2, wherein each of said sectors has a rear part with a height smaller than the height of a front part of the same sector.

4. The chair according to claim 2, wherein each of said sectors is provided with projections that engage cavities formed in an adjacent sector, said cavities having a shape complementary to said projections.

5. The chair according to claim 4, wherein said projections and said cavities have arched surfaces in mutual sliding contact.

6. The chair according to claim 1, wherein said sectors are formed by portions set on top of one another of an elongated monolithic body.

7. The chair according to claim 1, wherein said elastic element comprises a plurality of elongated strips set in contact with one another.

8. A chair comprising:

a base structure bearing a seat, the base structure including two rear tubular elements open at the top;

a backrest having two tubular portions open at the bottom and aligned to said tubular elements of the base structure; and two elastic devices, each of which has a top support inserted in one of the tubular portions of the backrest, a bottom support inserted in the corresponding tubular element of the base structure, and an elastic element having a top stretch fixed to the top support and a bottom stretch fixed to the bottom support, the elastic element being flexurally deformable to enable tilting between the top support and the bottom support, each of said elastic devices comprising a plurality of sectors set on top of one another and arranged between the top support and the bottom support, wherein the elastic element has a central stretch extending through said sectors and wherein, in a resting position of the elastic element, a plurality of slits are formed on the rear side of each elastic device between each pair of adjacent sectors, and wherein said sectors are formed by separate bodies, and said sectors are stacked on top of one another.

9. The chair according to claim 8, wherein each of said sectors has a rear part with a height smaller than the height of a front part of the same sector.

10. The chair according to claim 8, wherein each of said sectors is provided with projections that engage cavities formed in an adjacent sector, said cavities having a shape complementary to said projections.

11. The chair according to claim 10, wherein said projections and said cavities have arched surfaces in mutual sliding contact.

12. The chair according to claim 8, wherein the top support and the bottom support are each formed by a pair of side parts, fixed to one another on opposite sides of the top stretch or of the bottom stretch of the elastic element.

13. The chair according to claim 8, wherein said elastic element comprises a plurality of elongated strips set in contact with one another.

* * * * *